US007441427B2

(12) United States Patent
Vickers

(10) Patent No.: US 7,441,427 B2
(45) Date of Patent: Oct. 28, 2008

(54) BINARY CODED KEY AND TAMPER RESISTANT LATCH

(75) Inventor: James H. Vickers, Media, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/855,796

(22) Filed: Sep. 14, 2007

(65) Prior Publication Data

US 2008/0105014 A1 May 8, 2008

Related U.S. Application Data

(60) Provisional application No. 60/845,335, filed on Sep. 17, 2006.

(51) Int. Cl.
*E05B 65/06* (2006.01)

(52) U.S. Cl. ..... 70/127; 70/128; 70/404; 70/417; 70/419; 70/491; 292/57; 292/58; 292/64; 292/67

(58) Field of Classification Search ..... 70/127, 70/128, 403, 404, 491, 389, 417, 419, 381; 292/57, 58, 60–62, 64, 67
See application file for complete search history.

(56) References Cited

U.S. PATENT DOCUMENTS 1,083,438 A * 1/1914 Dohse ..... 70/100
1,674,513 A * 6/1928 Jacobi ..... 70/373
1,891,214 A * 12/1932 Falk ..... 70/368
1,907,625 A 5/1933 Vogt
2,049,742 A 8/1936 Lowe
2,143,127 A 1/1939 Leonard
3,339,384 A * 9/1967 Greenwald ..... 70/491
3,402,958 A 9/1968 Barry (Continued)

FOREIGN PATENT DOCUMENTS

FR 2006184 12/1969

(Continued)

OTHER PUBLICATIONS

Southco Handbook 2000 by Southco, Inc., 1999, pp. 28, 29, 36, 37, 112 and 113.

(Continued)

*Primary Examiner*—Lloyd A Gall
(74) *Attorney, Agent, or Firm*—Paul & Paul

(57) ABSTRACT

A latch has a bushing which has at least one bushing projection or means for preventing insertion of an unauthorized tool to rotate a latch actuator of the latch. Only a key having an outer key recess which can mate with bushing projection on the bushing permits insertion of the key. The cap subassembly of the latch is provided with projections which are of a size and so positioned as to correspond with the internal recesses of the key so as to allow the cap subassembly to enter into the bore of the key and permit a mating engagement of internal recesses on the key and projections on the cap subassembly. Because cap portion rotates freely on top of the cap subassembly which is the part of the cap driven by the key, the arrangement makes it impossible, or at least very difficult, to rotate the shaft and in turn the pawl by means of a tool which rotates the cap portion.

5 Claims, 21 Drawing Sheets

U.S. PATENT DOCUMENTS

| | | | | | |
|---|---|---|---|---|---|
| 3,524,335 | A | * | 8/1970 | George | 70/491 |
| 3,553,988 | A | * | 1/1971 | Fitzgerald | 70/433 |
| 3,648,492 | A | * | 3/1972 | Walters et al. | 70/491 |
| 3,903,720 | A | * | 9/1975 | Scherbing | 70/491 |
| 4,222,253 | A | * | 9/1980 | Peitsmeier | 70/417 |
| 4,556,244 | A | | 12/1985 | Bisbing | |
| 4,583,775 | A | | 4/1986 | Bisbing | |
| 4,621,510 | A | * | 11/1986 | Scherbing | 70/491 |
| 4,763,935 | A | | 8/1988 | Bisbing | |
| 4,878,367 | A | | 11/1989 | Bisbing | |
| 4,953,374 | A | * | 9/1990 | Wiebe | 70/416 |
| 5,020,349 | A | * | 6/1991 | Lee | 70/491 |
| 5,076,080 | A | | 12/1991 | Fuss et al. | |
| 5,165,738 | A | | 11/1992 | McCormack | |
| 5,263,348 | A | | 11/1993 | Wittwer | |
| 6,564,602 | B2 | * | 5/2003 | Gregory | 70/360 |
| 6,640,592 | B2 | | 11/2003 | Vickers | |

FOREIGN PATENT DOCUMENTS

| | | |
|---|---|---|
| WO | WO0049251 | 8/2000 |

OTHER PUBLICATIONS

Product Description by Strattec Security Corporation, dated 1997.
Southco Latches and Hardware Handbook 45, NA, by Southco, Inc., 1995, pp. E-8, E-9, G-16, and G-17.
Southco Handbook 2003 by Southco, Inc., 2003, pp. 23-42,62-65, 69, 77-85.
Southco 2005 New Product Supplement, pp. 10-23, 29-39.
Emka, General Catalogue 2007, pp. 7, 11-15, 17-26, 28-61.

* cited by examiner

ALTERNATE, THREE PIECE CAP SUB-ASSEMBLY

KEY WITH MULTIPLE SECURITY SLOTS (2)

BUSHING WITH MULTIPLE TABS

BINARY CODED KEY AND TAMPER RESISTANT LATCH

REFERENCE TO RELATED APPLICATION

This application claims priority to a provisional U.S. patent application Ser. No. 60/845,335 entitled "BINARY CODED KEY AND TAMPER RESISTANT LATCH" filed Sep. 17, 2006.

BACKGROUND OF THE INVENTION

1. Field of Invention

The present invention relates to the field of keys and to key operated latch-actuators.

The invention relates in particular to keys having a tubular stem and to latch-actuators having a stud for receiving the tubular key.

The keys and latch-actuators of the invention are adapted and can be made in a wide variety of binary-coded forms so that a particular latch will be openable only by a key having a binary-coded configuration corresponding to that of the latch-actuator.

2. Brief Description of the Related Art

Latches can be used to secure doors, panels or other members. It is desired that the latch be securely locked when the latch is not in use and therefore prevent unauthorized use by one who does not have a key or tool to unlock the latch. Once unlocked the latch can be opened and then closed.

Although many latches are known in the prior art, none are seen to teach or suggest the unique features of the present invention or to achieve the advantages of the present invention.

SUMMARY OF THE INVENTION

The present invention is directed to a latch for securing two members together and a key for opening the latch. The latch can be attached to one of the members such as a panel. The latch can be unlocked with the key by a user. Illustrated and described in U.S. Pat. Nos. 4,878,367 to Bisbing and 4,583,775 to Bisbing the specifications of which are herein incorporated in their entirety by reference, are forms of latches to which the key and latch-actuator can be applied.

A closure element or door has mounted thereon a latch having a support base and a shaft or means for rotating a pawl which can be mounted on the shaft The pawl is movable rotationally by the shaft and also can be movable in the longitudinal or axial direction of the shaft. To latch a door to a frame, the pawl is first rotated to a position such that it is in line with frame member. In one embodiment of the present invention the pawl can then be moved longitudinally so that it engages the edge of the frame member.

The key has a tubular stem The stem portion has a bore having an internal circumferential surface having at selected locations recesses of preselected circumferential width. In accordance with the present invention, the positions and circumferential width of the recesses vary from key to key, thus, each key is different from every other key.

The latch actuator comprises a cap portion, cap subassembly and a bushing. The bushing has at least one bushing projection or means for preventing insertion of the key such that the key can only be inserted in the bushing when outer key recesses are mated with the bushing projection thus permitting insertion of the key. The cap is provided with projections which are of a size and so positioned as to correspond with the recesses of the key so as to allow the cap to enter into the bore of the key thus resulting in a mating engagement thereof.

In a preferred embodiment of the present invention, the bushing rotates independently of the cap and a cap portion of the cap rotates independently of the cap subassembly which consists of the remaining portion or parts of the cap. Because the cap portion rotates freely from the cap subassembly which is the part of the cap driven by the key, the arrangement makes it impossible, or at least very difficult, to rotate the shaft and in turn the pawl by means of a tool other than the tubular key which mates with the cap subassembly of the latch-actuator.

In another embodiment of the invention, the cap portion which rotates freely and independently of the cap subassembly is held to the cap subassembly by a rivet.

BRIEF DESCRIPTION OF THE DRAWINGS

The present invention will be now described with reference to the accompanying drawings in which.

DETAILED DESCRIPTION OF THE INVENTION

Figure 2:
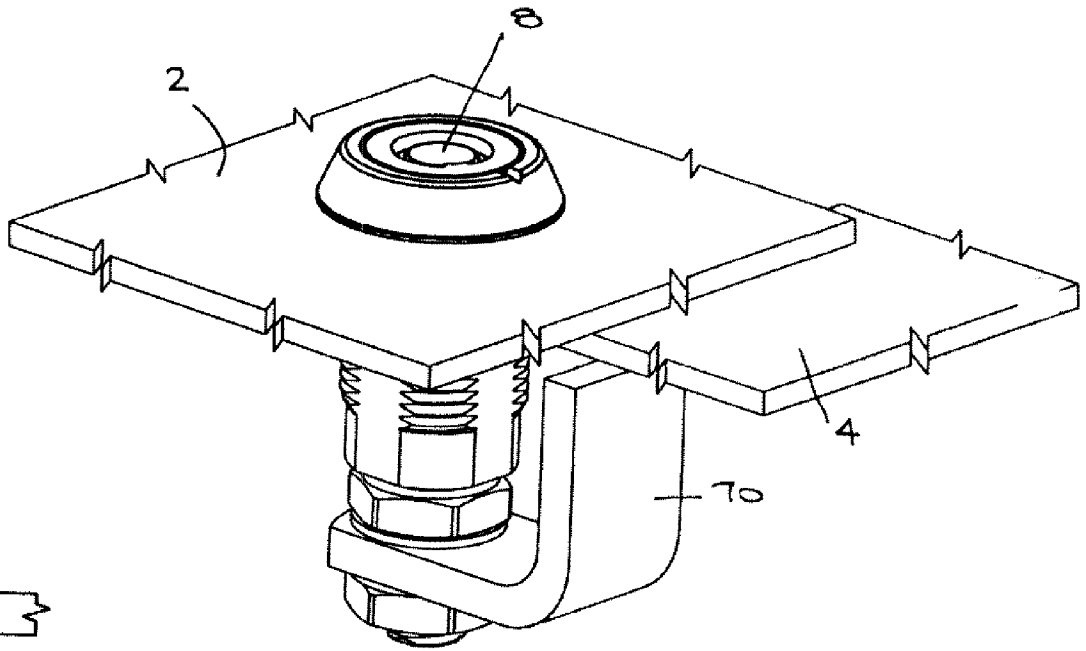
FIG. 2 shows a perspective view of the latch of FIG. 1 in the closed position.

As already indicated, the present invention is directed to a coded key and latch-actuator and these will now be described in detail.

Referring to FIGS. 5-9, key 80 has a flat handle portion 81 and a short tubular stem 83. A conical portion 82 provides reinforcement between the flat handle 81 and the tubular stem portion 83. Stem portion 83 has a bore having an internal circumferential surface having at selected locations recesses 85 of preselected circumferential width. The recesses 85 are clearly seen in FIGS. 5 and 9. The positions and circumferential width of the recesses 85 vary from key to key, preferably according to a binary code. Thus, each key is different from each other key.

It has been found convenient to express the key combination as a binary number in which a single notch or recess counts as a "zero" and an intervening single unnotched area counts as a "one". For example, the internal circumference of the bore of the tubular key 80 is assumed to be divided into twelve equal divisions. Assume that the count starts at a point in FIG. 9, and that the count is made in a clockwise direction. A key combination can be expressed as follows: 001101001101. That is to say, starting at given point and counting in the clockwise direction, such a key has two recesses, two nonrecesses, one recess, one nonrecess, two recesses, two nonrecesses, one recess and one nonrecess.

Figure 11:
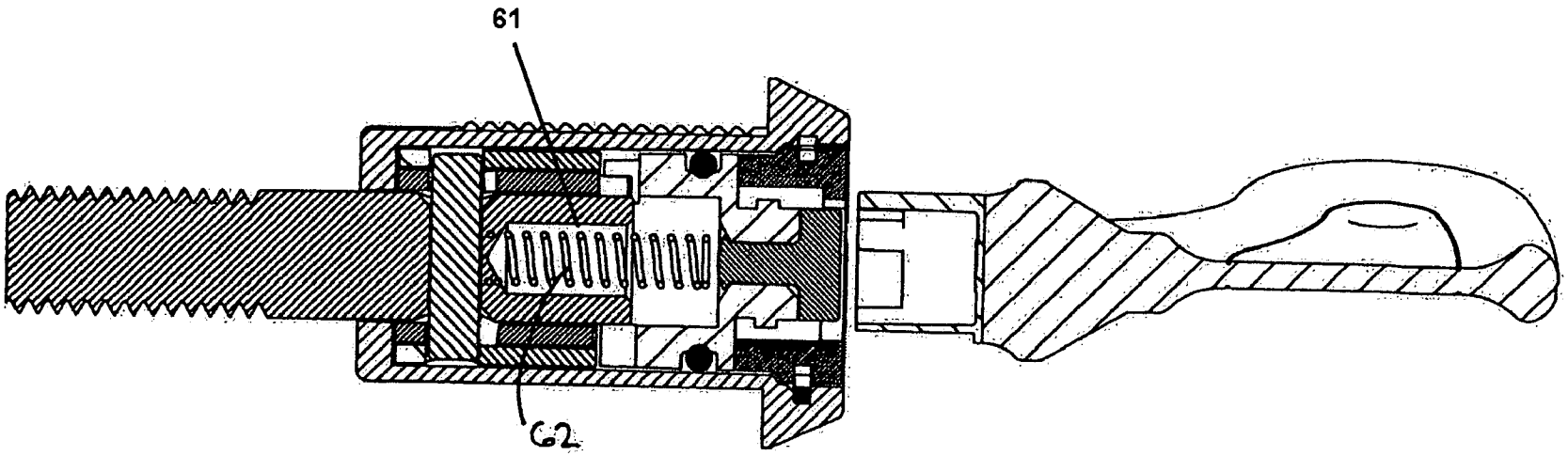
FIG. 11 is a sectional view of the latch of FIG. 14 in the open position and a sectional view of the key of FIG. 7.
Figure 12:
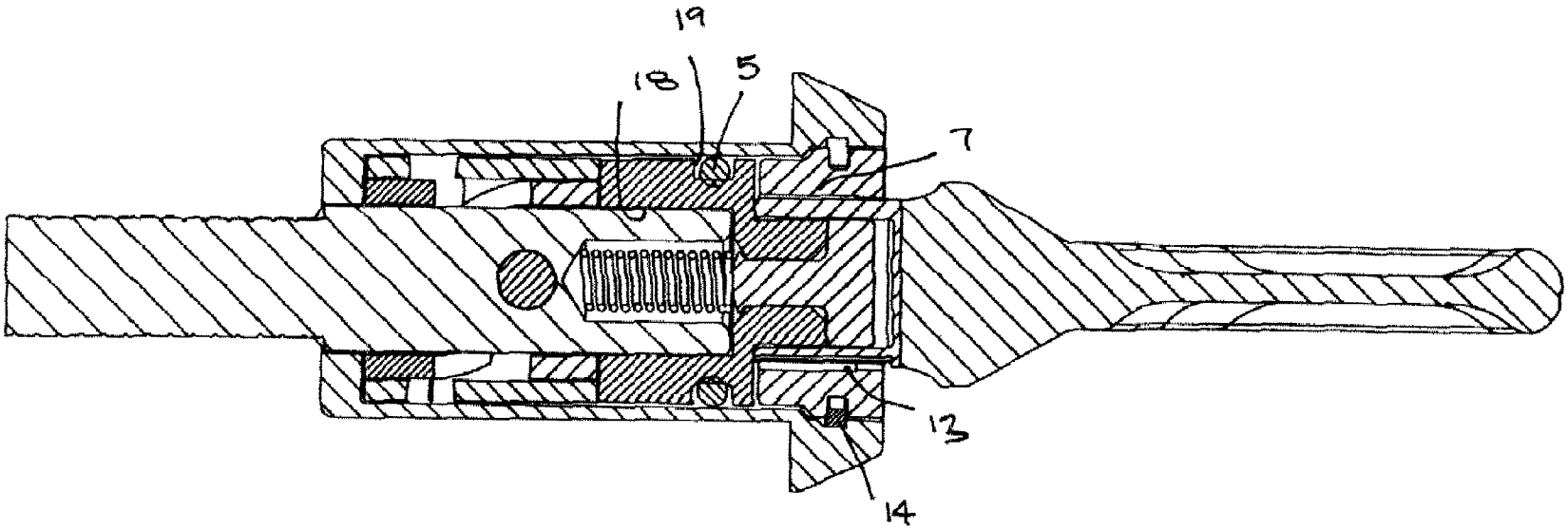
FIG. 12 is a sectional view of the latch of FIG. 14 in the closed position and a sectional view of the key of FIG. 7.
Figure 13:
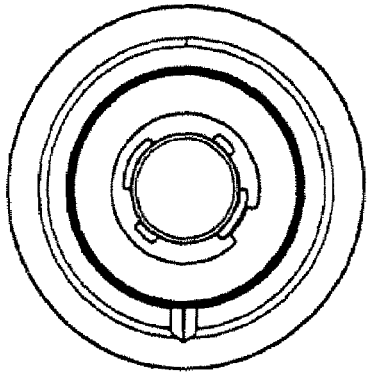
FIG. 13 is a top view of the latch of FIG. 14.
Figure 14:
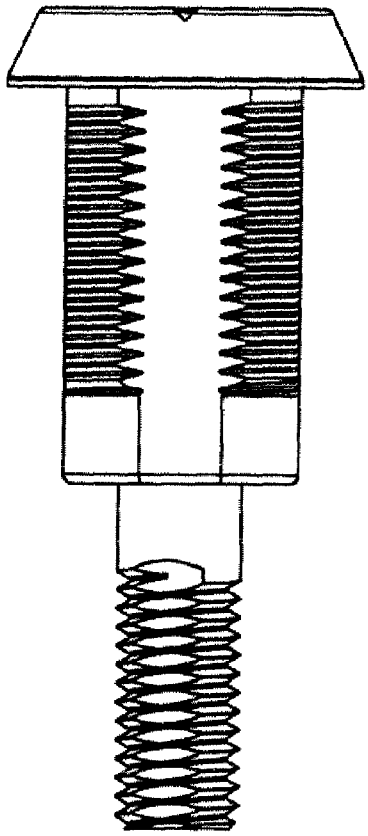
FIG. 14 is a side view of the latch according to one embodiment of the present invention shown without a pawl in the open position.
Figure 15:
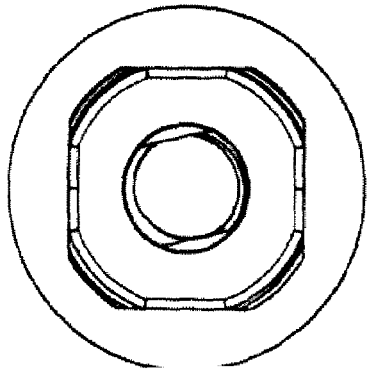
FIG. 15 is a bottom view of the latch of FIG. 14.
Figure 16:
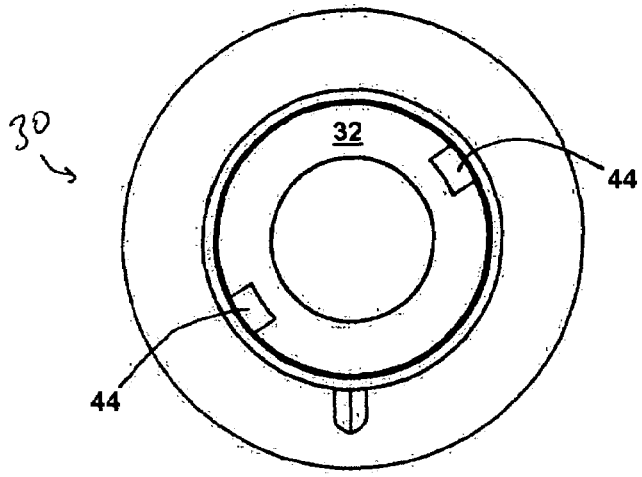
FIG. 16 is a top view of the support base of the latch of FIG. 14.
Figure 17:
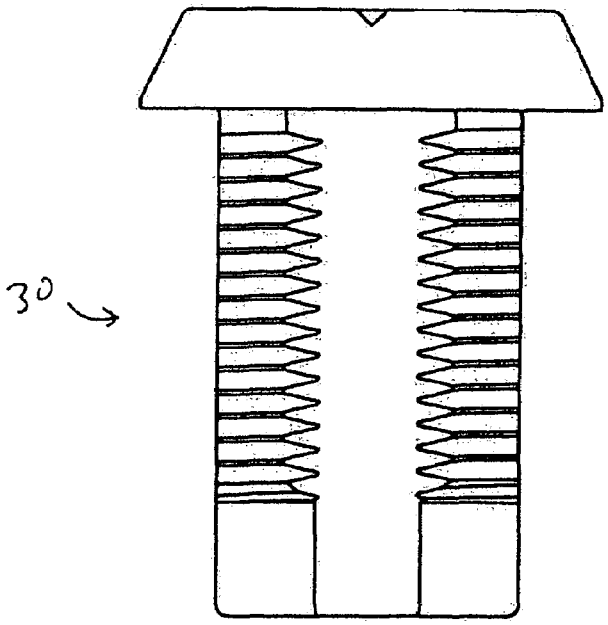
FIG. 17 is a side view of the support base of the latch of FIG. 14.
Figure 18:
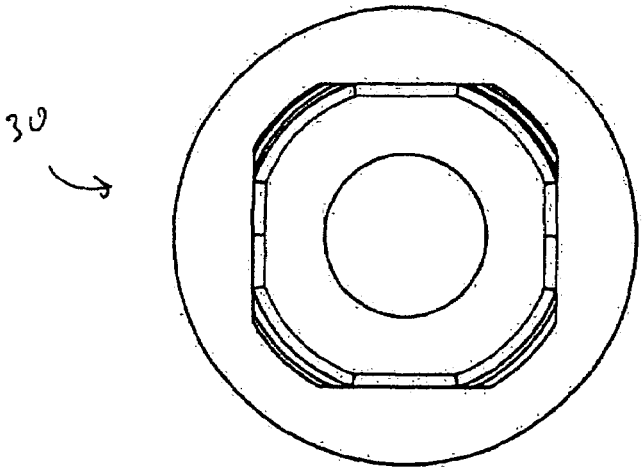
FIG. 18 is a bottom view of the support base of the latch of FIG. 14.
Figure 19:
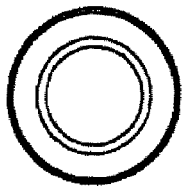
FIG. 19 is a top view of the shaft of FIG. 20 of the latch of FIG. 14.
Figure 20:
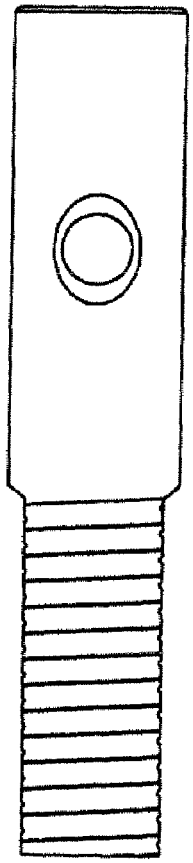
FIG. 20 is a side view of the shaft of the latch of FIG. 14.
Figure 21:
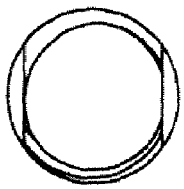
FIG. 21 is a bottom view of the shaft of FIG. 20.
Figure 22:
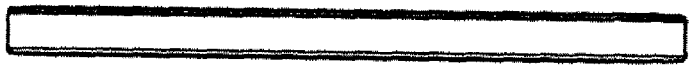
FIG. 22 is a side view of the retaining ring of the latch of FIG. 14.
Figure 23:
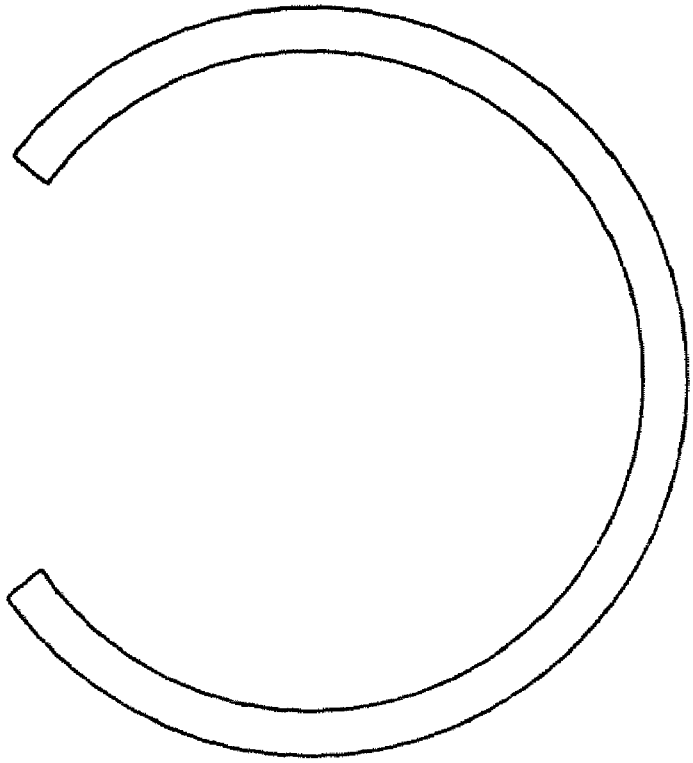
FIG. 23 is a top view of the retaining ring of the latch of FIG. 14.
Figure 24:
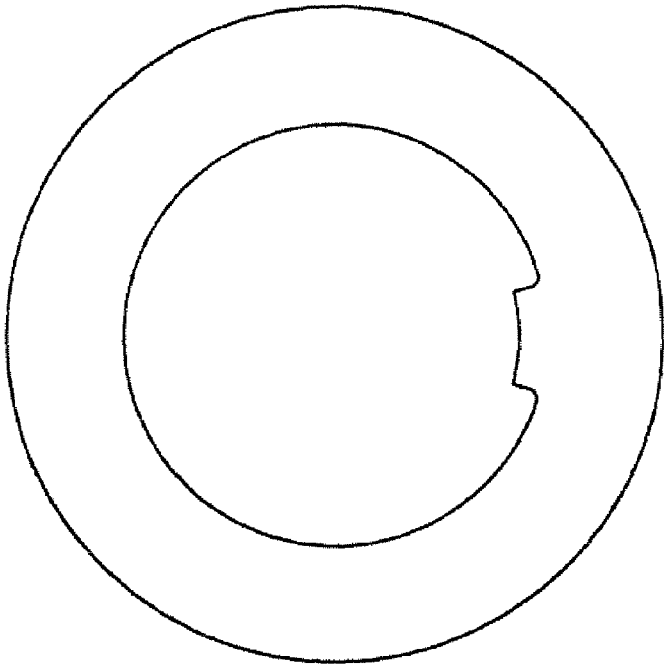
FIG. 24 is a top view of the bushing of the latch of FIG. 14.
Figure 25:
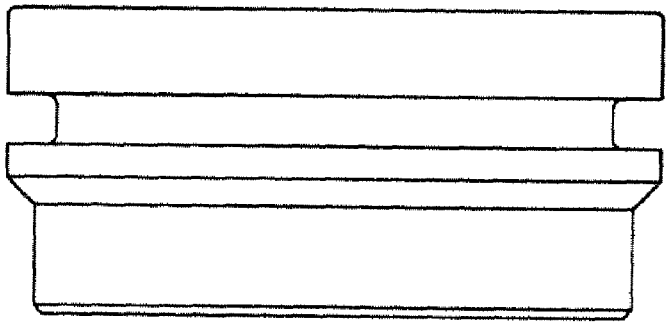
FIG. 25 is a side view of the bushing of the latch of FIG. 14.
Figure 26:
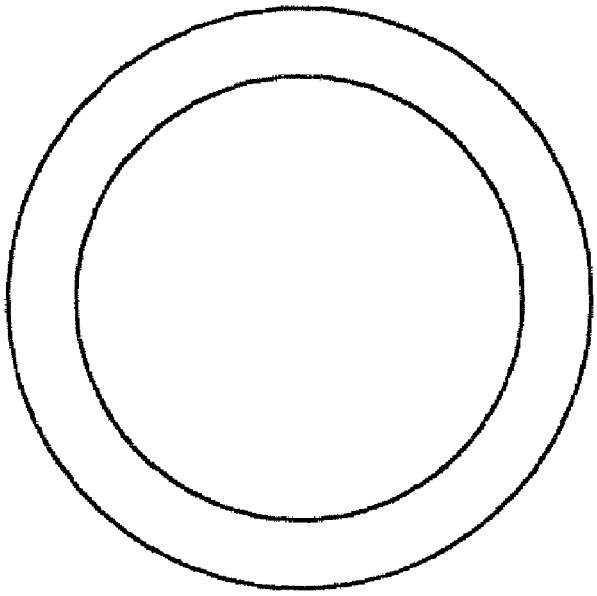
FIG. 26 is a top view of the o-ring of the latch of FIG. 14.
Figure 27:
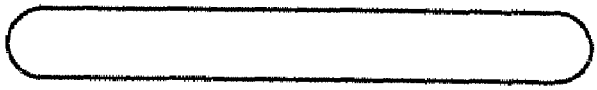
FIG. 27 is a side view of the o-ring of the latch of FIG. 14.
Figure 28:
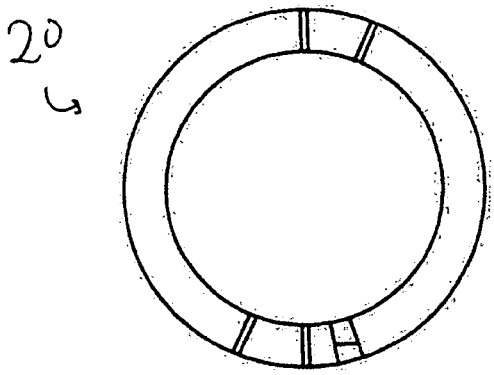
FIG. 28 is a top view of the cam of the latch of FIG. 14.
Figure 29:
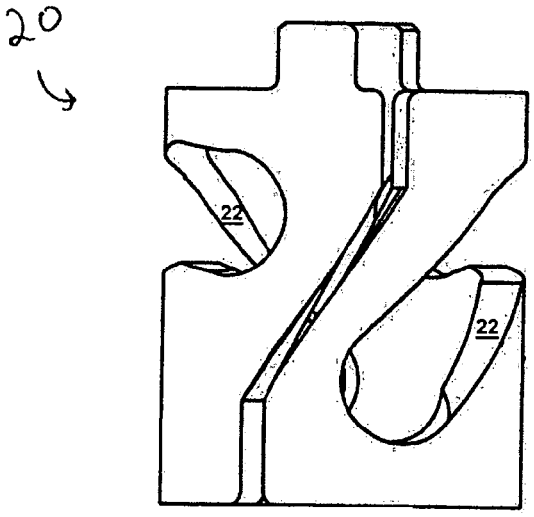
FIG. 29 is a front view of the cam of the latch of FIG. 14.
Figure 30:
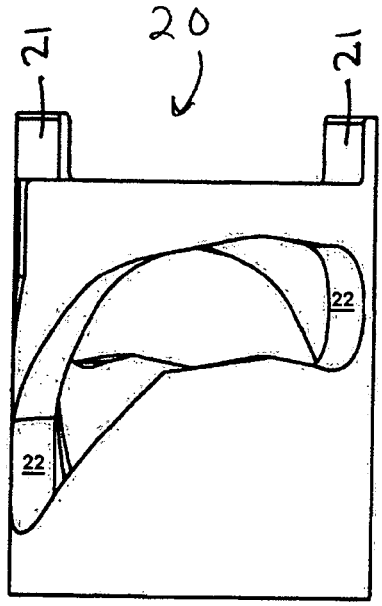
FIG. 30 is a side view of the cam of the latch of FIG. 14.
Figure 31:
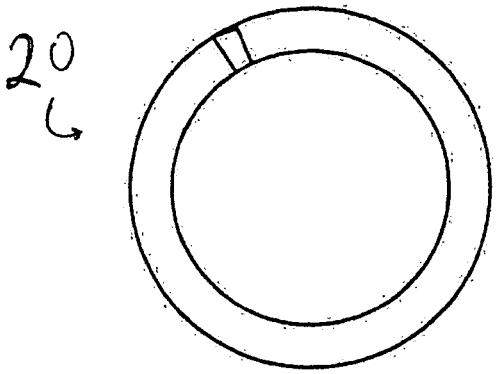
FIG. 31 is a bottom view of the cam of the latch of FIG. 14.
Figure 32:
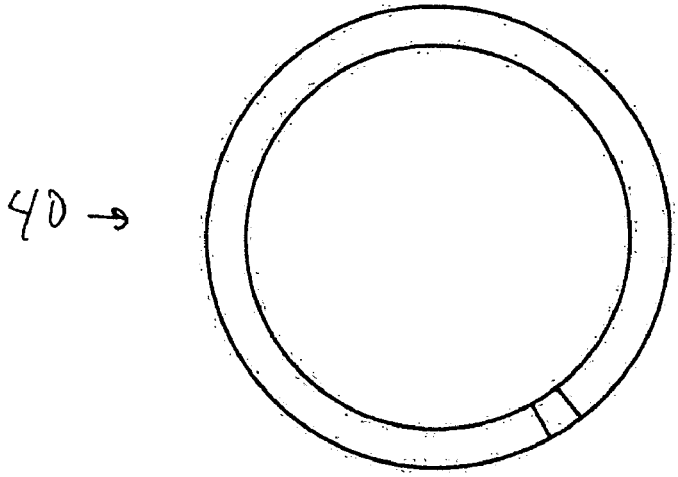
FIG. 32 is a top view of the sleeve of the latch of FIG. 14.
Figure 33:
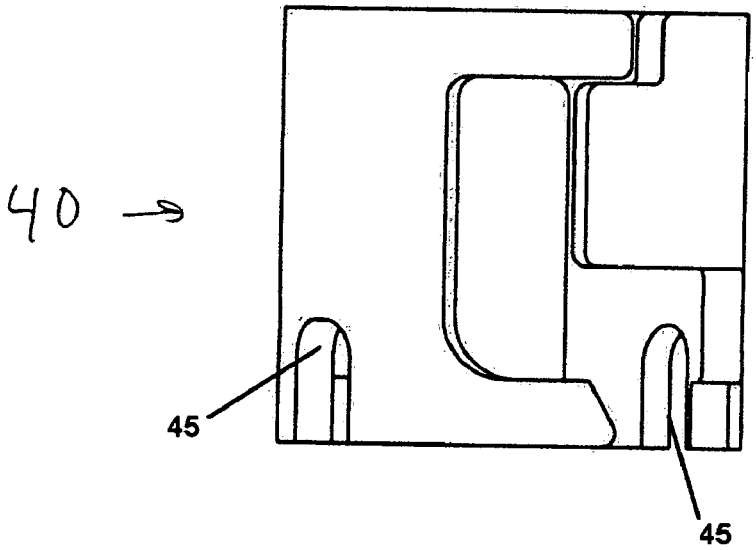
FIG. 33 is a side view of the sleeve of the latch of FIG. 14.
Figure 34:
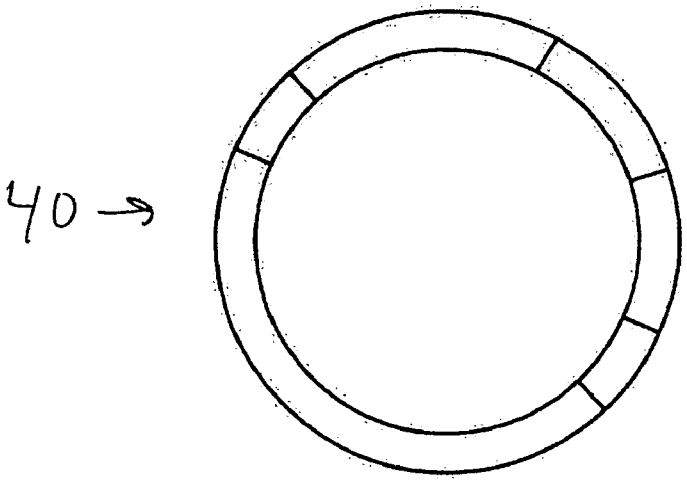
FIG. 34 is a bottom view of the sleeve of the latch of FIG. 14.
Figure 35:
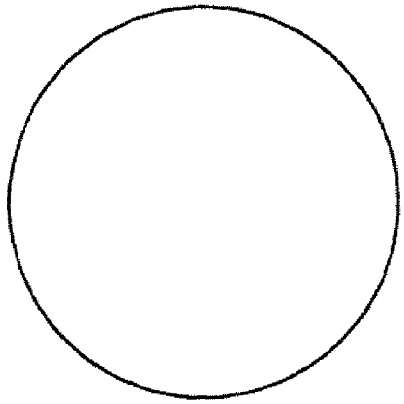
FIG. 35 is a top view of the cap portion of the latch of FIG. 14.
Figure 36:
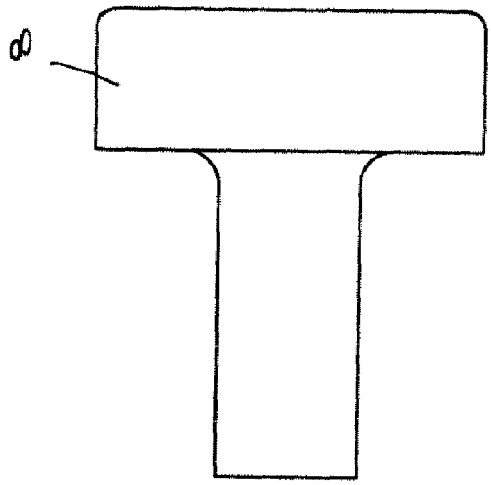
FIG. 36 is a side view of the cap portion of the latch of FIG. 14.
Figure 37:
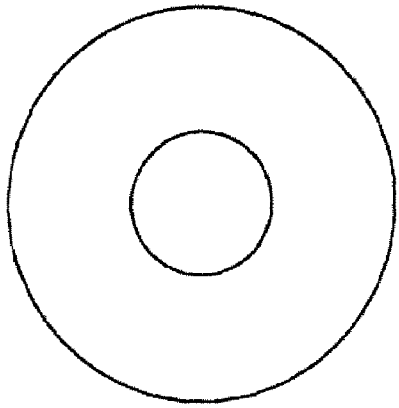
FIG. 37 is a bottom view of the cap portion of the latch of FIG. 14.
Figure 38:
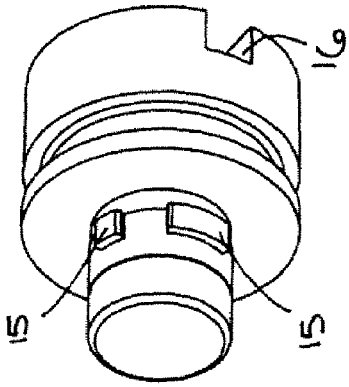
FIG. 38 is a perspective view of the cap of the latch of FIG. 14.
Figure 39:
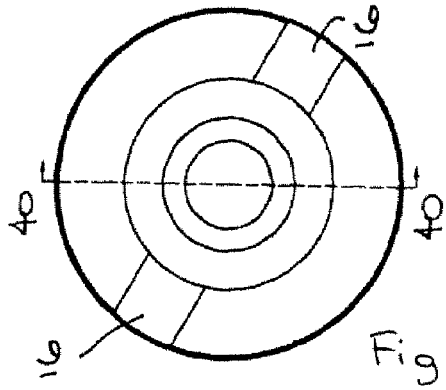
FIG. 39 is a bottom view of the cap of the latch of FIG. 14.
Figure 41:
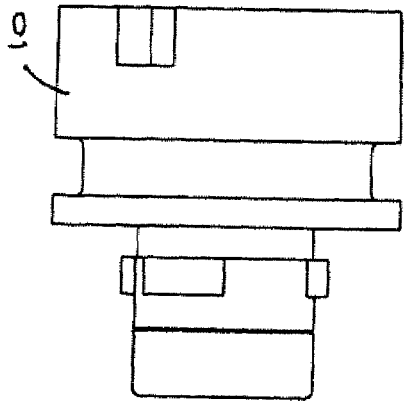
FIG. 41 is a side view of the cap of the latch of FIG. 14.
Figure 40:
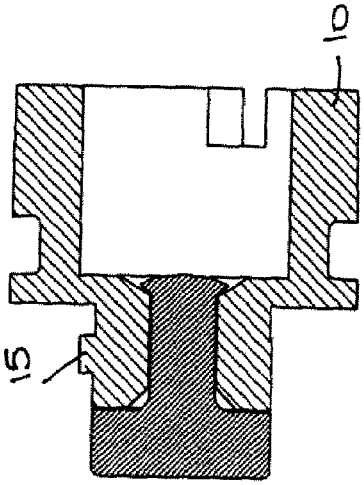
FIG. 40 is a sectional view taken along line 40-40 of the cap of the latch of FIG. 39.
Figure 42:
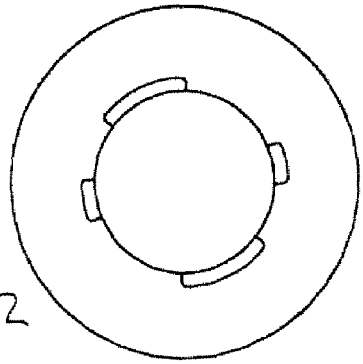
FIG. 42 is a top view of the cap of the latch of FIG. 14.
Figure 43:
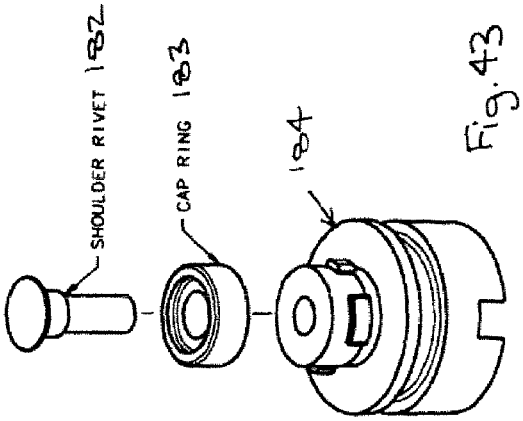
FIG. 43 is an alternate embodiment of a cap of the latch of FIG. 14.
Figure 44:
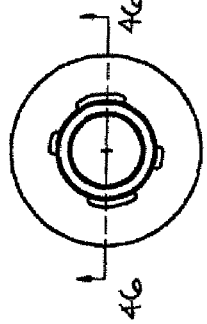
FIG. 44 is a top view of the cap of FIG. 43.
Figure 45:
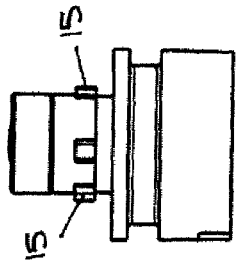
FIG. 45 is a side view of the cap of FIG. 43.

In FIG. 12, the tubular binary-coded stem 83 of key 80 is insertable into an annular cavity 13, and in so doing mates with the key-receiving cap subassembly 10 of the latch actuator which also comprises bushing 9 and cap portion 8. As seen in FIGS. 38-42, the cap subassembly 10 is provided with a stud having projections 15 which are of a size and so positioned as to correspond with the recesses 85 of the key 80 so as to allow the stud of the cap subassembly 10 to enter into the bore of the key 80. As seen in FIGS. 11 and 12, when the tubular binary-coded stem portion 83 of key 80 is inserted into the annular cavity 13, the outer circumferential surface of the stem 83 comes into sliding engagement with bushing wall 7 of bushing 9.

Figure 54:
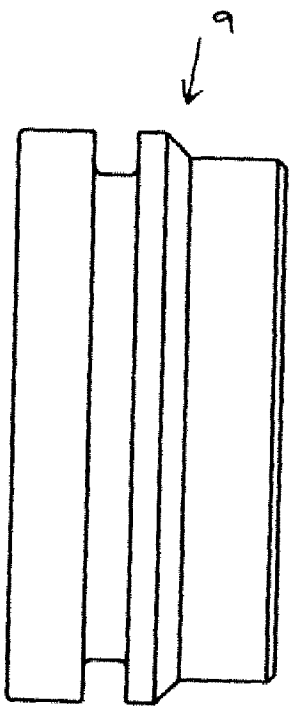
FIG. 54 is a side view of an alternate embodiment of a bushing of the present invention.
Figure 55:
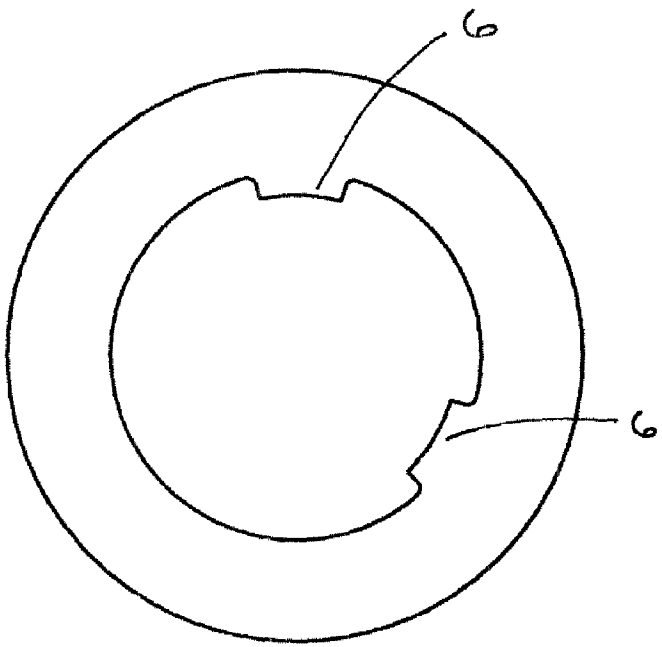
FIG. 55 is a top view of the bushing of FIG. 54.

The bushing 9 has at least one bushing projection 6 or means for preventing insertion of an unauthorized tool such that the key 80 can only be inserted in the bushing 9 when outer key recess(es) 86 are mated with the bushing projection (s) 6 thus permitting insertion of the key 80. The cap subassembly 10 is provided with a stud having projections 15 which are of a size and so positioned as to correspond with the recesses 85 of the key 80 so as to allow the stud of the cap subassembly 10 to enter into the bore of the key 80 thus resulting in a mating engagement of key recesses 85 on key 80 and projections 15 on the stud. In an alternate embodiment of the present invention the bushing 9 can have two or more bushing projections 6 as seen in FIGS. 54 and 55 which prevent the insertion of a tool other than a key 80 which has an outer key recess 86 that corresponds to each of the bushing projections 6 and permits passage of the key 80.

The cap portion 8 rotates independently of the cap subassembly 10 which consists of the remaining portion or parts of the cap. In a preferred embodiment of the present invention, the bushing 9 rotates independently of the cap portion 8 and the cap subassembly 10. Because the cap portion 8 rotates freely from the cap subassembly 10 which is the part of the cap driven by the key 80, the arrangement makes it impossible, or at least very difficult, to rotate the shaft 50 and in turn the pawl 70 by means of a tool other than the tubular key 80 which mates with the stud on the cap subassembly 10 of the latch-actuator.

Figure 1:
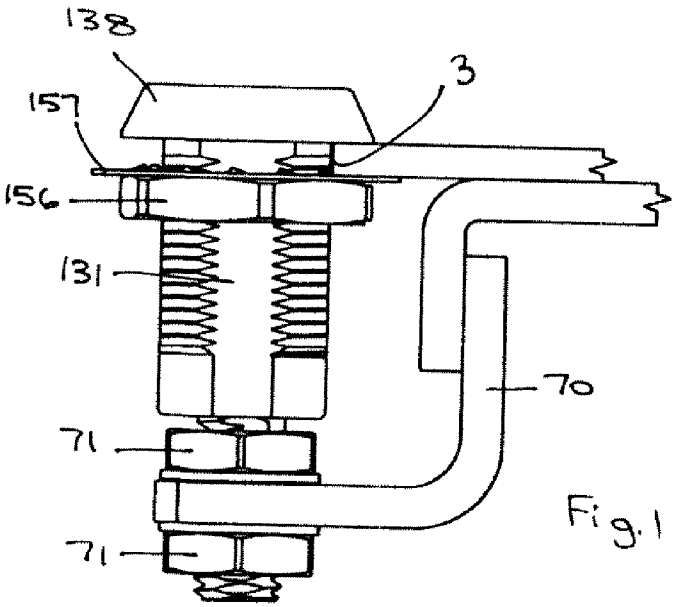
FIG. 1 shows a side view of an embodiment of a latch according to the present invention installed in a panel and in the closed position.

Illustrated in FIGS. 1-4 is one form of latch to which the new binary-coded key and tamper resistant latch-actuator may be applied since the present application is not limited to the particular latch shown in FIGS. 1 and 2.

A latch is shown which uses a single cross pin 60 mounted on and carried by the shaft 50 which carries the latching pawl 70. This single cross pin 60 functions both as a cam follower and also as a motion-control pin. Cam slots 25 are provided for each end of the cross pin 60. Two sets intersecting motion-control slots, i.e. axial slots 41 and circumferential slots 41 are provided in a sleeve 40. When the cross pin 60 is in the axial motion-control slot 42, only axial movement of the latching pawl 70 is possible. When the cross pin 60 is in the lateral motion-control slot 41 or recess, only angular movement of the latching pawl 70 is possible. The structural arrangement is such that during a single continuous turning motion of the latch 1, the cross pin 60 transfers from one of the motion-control slots 41 to the other, thereby to achieve, in sequence, during unlatching, axial and then angular movement of the latching pawl 70, and to achieve, in sequence, during latching, angular and then axial movement of the latching pawl 70. The sequential steps may, however, be reversed by modifying the latch structure.

The major components of a latch of the present invention are a drive plug or cap subassembly 10 a bushing 9, a support base 30, a rotatable slotted sleeve cam 20, a fixed slotted motion-control sleeve 40, a shaft 50, and a latch pawl 70. Shaft 50 carries a cross pin 60 which functions both as a cam follower and also as a motion-control pin.

As seen in FIGS. 11 and 12, cap subassembly 10 as shown can have projections 15 for mating with inner recesses 85 of key 80. As seen in FIG. 12, the cap subassembly 10 has a cylindrical bore 18 which receives the outward end of shaft 50. Cap subassembly 10 is rotatable within support base 30. Bushing 9 is prevented from movement in the axial direction of shaft 50 by a retaining ring 14 which is received within grooves 13 located in registered positions in bushing 9 and support base 30. O-ring 5 fits in groove 19 of cap subassembly 10 to prevent the entry of moisture and dust.

Figure 10:
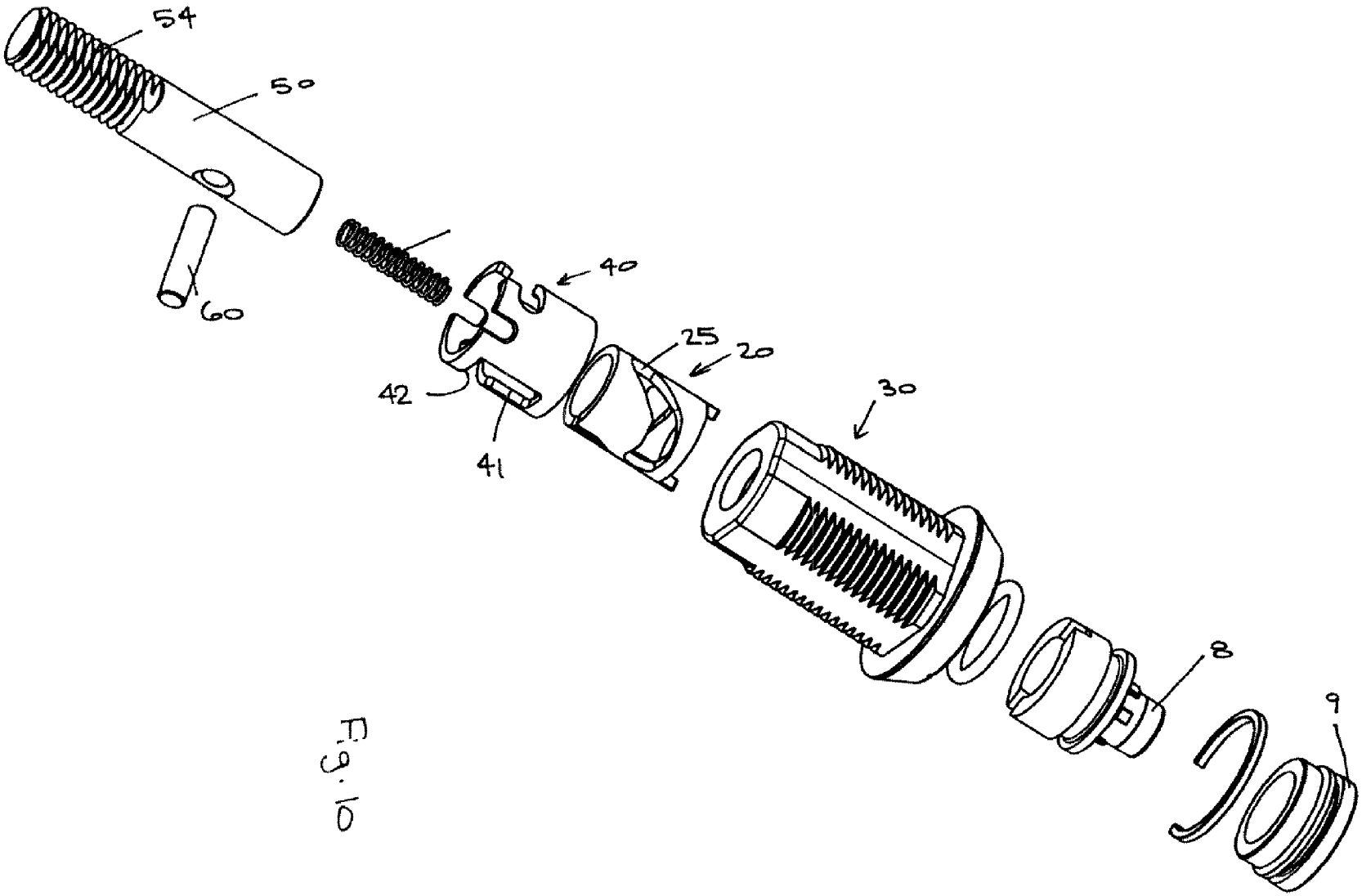
FIG. 10 is an exploded view of the latch of FIG. 1.

As seen in FIG. 10 the inward end of cap subassembly 1 is provided with a pair of notches 16 which receive ears 21 which project axially outwardly from a sleeve-like cam 20. Thus, when cap subassembly 10 is rotated, as by key 80, the sleeve-like cam 20 is also rotated.

The sleeve-like cam 20 is provided with a pair of cam slots 25 spaced 180 degrees apart circumferentially. Each of the cam slots 25 runs in a direction which has both circumferential and axial components.

Positioned coaxially between shaft 50 and the sleeve-like cam 20 is a fixed motion control sleeve 40 having a pair of axial slots 41 and a pair of circumferential slots 42. One slot of each pair is spaced 180 degrees from the other. The inward end of each axial slot 41 connects with one end of one of the circumferential slots 42. The motion-control sleeve 40 is prevented from moving rotationally relative to support base 30 by a pair of ears 44 which project axially inwardly into slots 45 in the inward end 32 of the support base 30.

The support base 30 is a generally hollow cylindrical component which is mounted on the door 2 of the cabinet in a rectangular or square cutout portion 3 of the door 2, while a sleeve portion 131 projects inwardly through a hole or opening in door 2. The inward end 32 of support base 30 is closed except for a central hole through which shaft 50 passes. The inward ends of the fixed motion-control sleeve 40 and rotatable sleeve-like cam 20 abut against the end 32 of the support base 30.

The pairs of respective axial and circumferential slots 41 and 42 in the fixed motion-control sleeve 40 function respectively as axial motion-control slots and as lateral motion-control slots. These motion-control slots receive in sequence, in one order or the other, the opposite ends of cross pin 60, as will be described.

Shaft 50 is an elongated shaft, the outer or head end of which is received within the cavity or bore 18 in cap subassembly 10. Shaft 50 projects inwardly through the hole in the inward end 32 of support base 30, and beyond, with the shaft 50 so supported that the center axis of the shaft 50 coincides with the center axis of motion-control sleeve 40 and cam 20. The inner end 54 of shaft 50 is threaded, and thereon is mounted a latching pawl 70, with the position of the pawl 70 on the shaft 50 being held in place by a pair of nuts 71 and being axially adjustable.

The relative positions of motion-control sleeve 40 and cam 20 could be reversed. That is, motion-control sleeve 40 could be radially outside of cam 20 rather than within 20 as shown.

Mounted on shaft 50 is the cross pin 60 which projects laterally in both directions from the shaft. Cross pin 60 functions as a cam follower and also as a motion-control pin.

The outward end of shaft 50 is provided with a center bore 61 in which a coil compression spring 62 is placed. The outward end of compression spring 62 bears against the cap 10. Thus, compression spring 62 biases shaft 50 inwardly toward the unlatching position. This biasing force maintains the ends of cross pin 60 in close contact with the inner wall 22 of cam slot 25. The biasing spring 62 is desirable but not essential since even without the spring 62 the ends of the cross pin 60 would follow the cam slots 25. However, the cam slots 25 have a width which is somewhat greater than the diameter of the cross pin 60 and accordingly the biasing spring 62 is useful in maintaining the cross pin 60 against the inward wall of the axial and circumferential slots 41 and 42 respectively. Cross pin 60 controls whether, in response to rotation of the cap subassembly 10, shaft 50 and pawl 70 will move only axially or only angularly. This is determined by whether the opposite ends of pin 60 are within the axial motion-control slots 41 or in the lateral motion-control slots 42.

OPERATION

As seen best in FIGS. 11 and 12, when cap subassembly 10 is rotated, as by key 80, the sleeve-like cam 20 will be driven rotationally due to the projection of cam ears 21 into the notches 16 in cap subassembly 10. When cam 20 is rotated, cross pin 60 is moved, but whether the movement is axial or lateral is dependent upon whether the ends of pin 60 are in the axial or lateral slots of the motion-control sleeve 40.

In FIG. 12 the latch is shown in the fully latched position in which the latch pawl 70 is in alignment with, and in engagement with, the striker or cabinet frame (not shown). When in the latched position, cap subassembly 10 is at its fully closed position, and the two opposite ends of cross pin 60 project through the axial slots 41 in the motion-control sleeve 40 and into the closed outermost ends of cam slots 25.

To unlatch the door 2 from the cabinet frame 4, cap subassembly 10 is turned in the counterclockwise direction when viewing FIGS. 1 and 2. When this is done, cap subassembly 10 and cam 20 rotate as a unit. The cross pin 60 cannot move rotationally because opposite ends of cross pin 60 are within the diametrically-opposed axial slots 41 of the fixed motion-control sleeve 40. As a result, when cam 20 is rotated counterclockwise to the position shown in FIG. 4, the force of the biasing spring 62 causes the opposite ends of cross pin 60 to follow the inward walls 22 of the opposed cam slots 25, and, as a result, cross pin 60, and hence also shaft 50 and latch pawl 70, move in the inward unlatched direction until the ends of the pin 60 reach the lateral slots 42.

Figure 4:
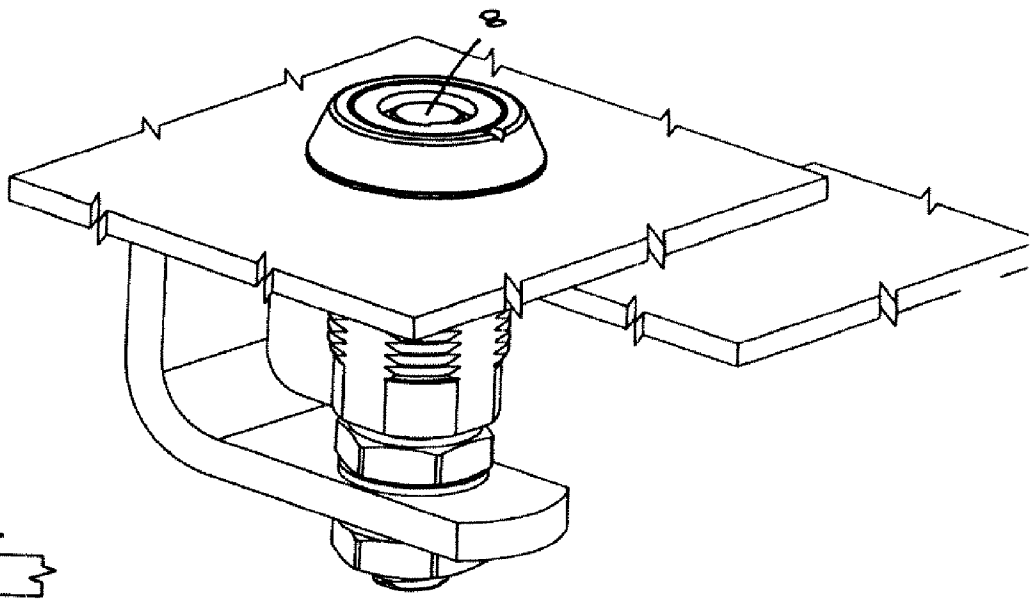
FIG. 4 shows a perspective view of the latch of FIG. 1 in the open position.
Figure 3:
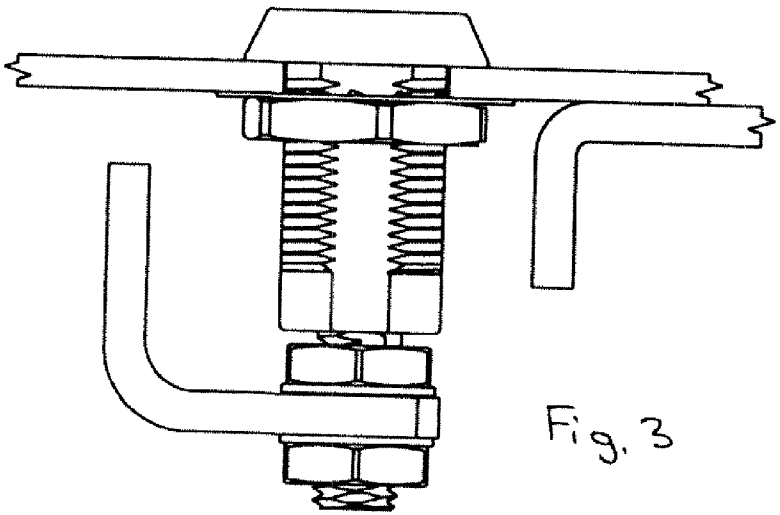
FIG. 3 shows a side view of an embodiment of a latch according to FIG. 1 installed in a panel and in the open position.
Figure 7:
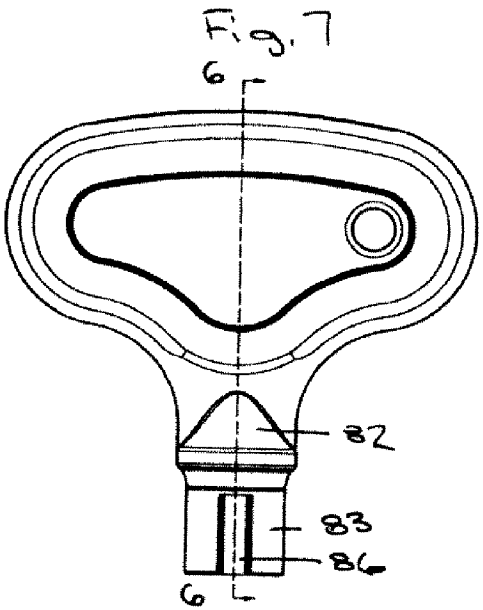
FIG. 7 is a side view of the key of FIG. 5.
Figure 8:
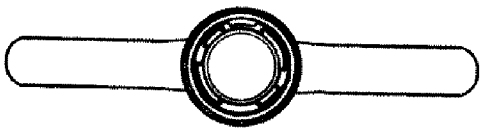
FIG. 8 is a bottom view of the key of FIG. 5.
Figure 6:
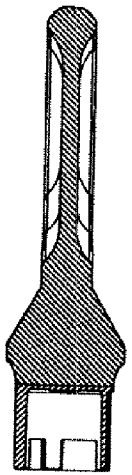
FIG. 6 is a sectional view taken along line 6-6 of the latch of FIG. 7.
Figure 9:
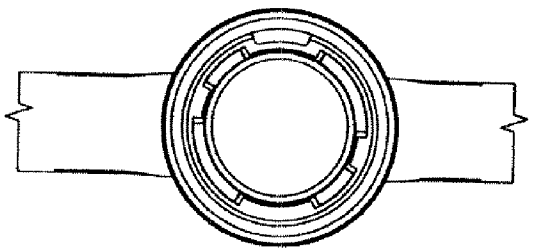
FIG. 9 is an enlarged view of a portion of FIG. 8.
Figure 5:
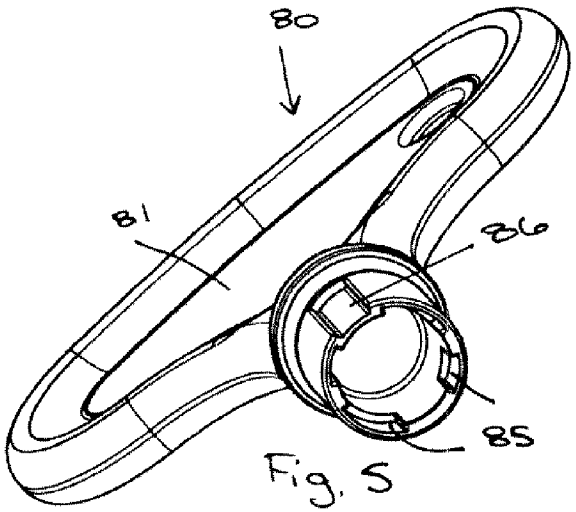
FIG. 5 is a perspective view of a key according to the present invention.

After cap subassembly 10 and cam 20 have been rotated as a unit cross pin 60 has moved axially inwardly, and is now aligned with the opposed lateral slots 42. Further rotation of cap 10 and cam 20 now causes rotational movement of cross pin 60, shaft 50 and pawl 70, as the opposed ends of cross pin 60 move into the opposed lateral circumferential slots 42. In this manner, pawl 70 is moved out of alignment with frame member 4 and, after further rotation, the door 2 is fully unlatched, as is illustrated in FIG. 4.

The latching action is simply the reverse of the unlatching action which has just been described. On latching, as cap subassembly 10 is turned clockwise, the opposite ends of cross pin 60 move laterally in the lateral circumferential slots 42 and shaft 50 rotates on its axis. Then the cross pin 60 translates axially outwardly. These sequential motions are caused by the cam walls 22 of the cam slots 25 which urge the ends of the cross pin 60 through the lateral motion-control circumferential slots 42 in the lateral or circumferential direction until the ends of the cross pin 60 abut against the edge of the axial motion-control slots 41. Thereafter, cam walls 22 of the cam slots 25 urge the ends of the cross pin 60 axially outwardly through axial slots 41. Thus, cam 20 and the motion-control slots, i.e. axial slots 41 and circumferential slots 42 cause the angular and axial motions to take place in sequence, in response to turning the cap subassembly 10 in the latching direction in one continuous motion.

As seen in FIGS. 1-4, the support base 30, has a portion 138 on the outer surface of the door 2 which is circular in shape. The sleeve portion 131, which extends inwardly through the hole in the door, is externally threaded and a nut 156 is screwed onto the sleeve portion 131 until the nut 156 abuts against the inner surface of the door 2. A lock washer 157 may desirably be used between the nut 156 and the door 2. In this manner, the latch 1 is securely mounted onto the door 2. The new latch has been described as mounted on the movable door 2. This is the preferred location. However, a latch embodying the basic concept of the present invention could be mounted on the fixed cabinet rather than on the door. In such case, the shaft and latch pawl would be moved angularly to engage a keeper mounted on the inside of the door and then axially inwardly to pull the door to tightly closed position. This is the reverse of the axial motion used to pull the door tightly shut when the latch is mounted on the door.

Figure 46:
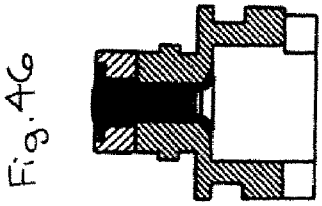
FIG. 46 is a sectional view taken along line 46-46 of the cap of FIG. 44.
Figure 47:
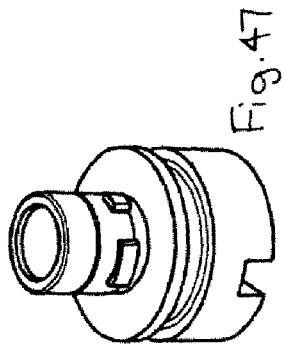
FIG. 47 is a perspective view of the cap of FIG. 43.
Figure 48:
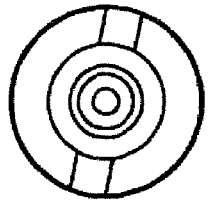
FIG. 48 is a bottom view of the cap of FIG. 43.
Figure 50:
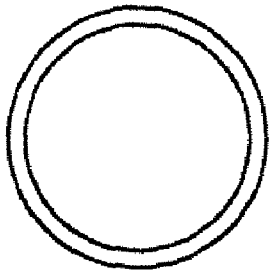
FIG. 50 is a side view of the pin of the latch of FIG. 14.
Figure 49:
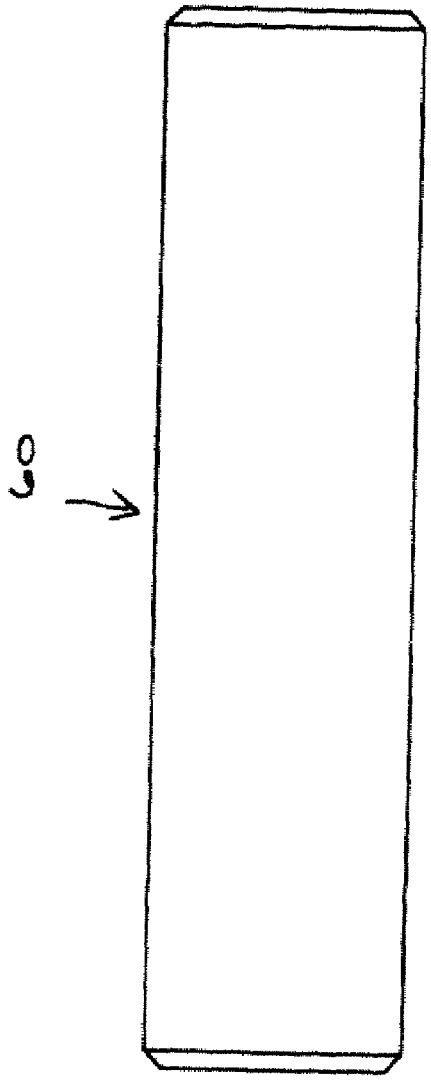
FIG. 49 is a top view of the pin of the latch of FIG. 14.
Figure 52:
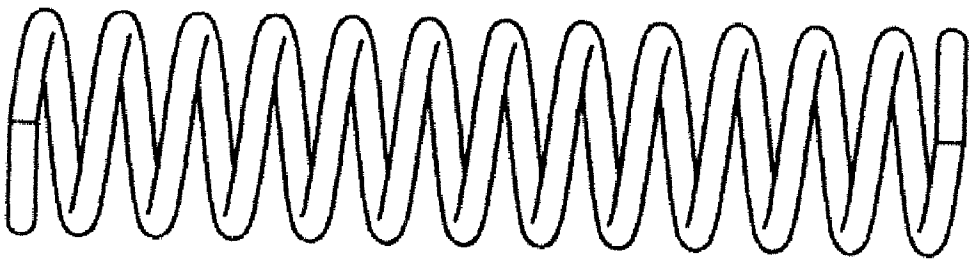
FIG. 52 is a side view of the spring of the latch of FIG. 14.
Figure 51:
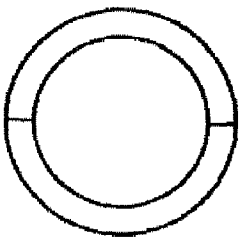
FIG. 51 is a top view of the spring of the latch of FIG. 14.
Figure 53:
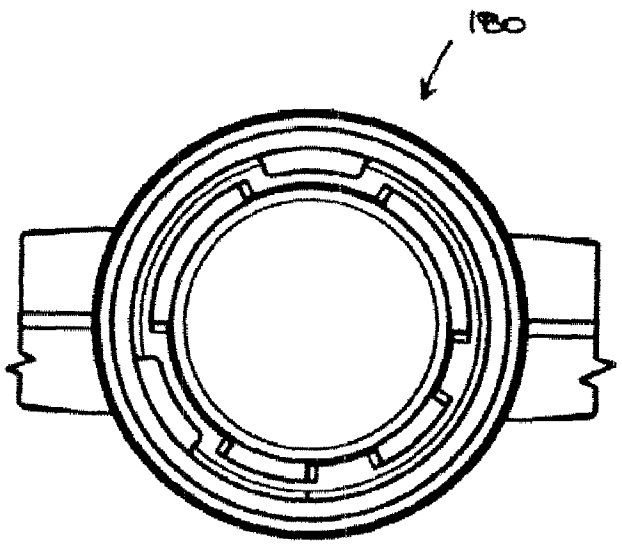
FIG. 53 is a partial bottom view of an alternate embodiment of a key of the present invention.

An alternate embodiment of the present invention is shown in FIGS. 43-48 which sets forth a two-piece cap subassembly which comprises shoulder rivet 182 which is inserted into cap ring 183 and flared seen in FIG. 46. After shoulder rivet 182 is flared cap ring 183 should still rotate freely from cap base 184.

The latch and all external components can be stainless steel for high strength and toughness and to ensure tamper-resistance.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

I claim:

1. A latch comprising:

a bushing, said bushing having a bushing bore therethrough forming an inner bushing circumferential surface;

an actuator comprising a cap portion and a cap subassembly, said cap subassembly having a stud with radial stud projections projecting therefrom and said stud having a top surface, said cap portion having a head and a pin extending therefrom wherein said pin penetrates said top surface and engages said stud , such that said head is capable of rotating on said top surface independently from said cap subassembly, and said stud and said cap portion extend into said bushing bore;

a cam sleeve having a cam slot;

a support base having an aperture at one end, said support base housing said actuator and said cam sleeve, wherein said cam sleeve is located between said aperture and said actuator and said cap subassembly engages said cam sleeve;

a shaft having a proximal end and a distal end and a radial cross-pin between said proximal and said distal end, wherein said proximal end is adjacent to said stud of said cap subassembly, said shaft extends through said cam sleeve and said aperture in said support base, and said radial cross-pin is in contact with said cam slot of said cam sleeve; and a pawl affixed to said shaft;

whereby rotation of said cap subassembly rotates said cam sleeve and said cam slot acts upon said radial cross-pin causing axial and angular movement of said shaft and consequently said pawl between latched and unlatched positions of said pawl.

2. The latch of claim 1 in combination with a binary-coded key, said binary-coded key comprising:

a tubular stem forming an internal bore, said stem having radial recesses in an inner circumferential wall of said stem of a preselected number and at preselected locations, the size and location of said radial recesses corresponding to said stud projections of said stud to permit said stud to be received within the bore of said tubular stem of said key;

wherein the surface of the inner circumferential wall of said tubular stem is considered to be divided circumferentially into a predetermined number of equal divisions, each division corresponding to a "0" or a "1" in the binary code according to whether said division is recessed or non-recessed; and wherein the number and locations of the recesses in the key stem are fixed in accordance with said binary code.

3. The latch of claim 1, wherein said inner bushing circumferential surface has at least one radial bushing projection projecting therefrom.

4. The latch of claim 3 in combination with a binary-coded key, said binary-coded key comprising:

a tubular stem forming an internal bore, said stem having radial recesses in an inner circumferential wall of said stem of a preselected number and at preselected locations and said tubular stem having at least one outer key recess on an outer circumferential wall of said stem, the size and location of said radial recesses corresponding to said stud projections of said stud and the size and location of said outer key recess corresponding to said radial bushing projection of said inner bushing circumferential surface to permit said stud to be received within the bore of said tubular stem of said key;

wherein the surface of the inner circumferential wall of said tubular stem is considered to be divided circumferentially into a predetermined number of equal divisions, each division corresponding to a "0" or a "1" in the binary code according to whether said division is recessed or non-recessed; and wherein the number and locations of the recesses in the key stem are fixed in accordance with said binary code.

5. The latch of claim 1, wherein said head is a cap ring having an aperture generally through the center of said cap ring; and said pin is a shoulder rivet, wherein said shoulder rivet is inserted through said aperture of said cap ring and into said stud of said cap subassembly.

* * * * *

UNITED STATES PATENT AND TRADEMARK OFFICE

CERTIFICATE OF CORRECTION

PATENT NO. : 7,441,427 B2
APPLICATION NO. : 11/855796
DATED : October 28, 2008
INVENTOR(S) : James H. Vickers It is certified that error appears in the above-identified patent and that said Letters Patent is hereby corrected as shown below:

In the Abstract, line 2, delete “or means”;
line 14, replace “by means of” with -- with --.

Column 4, line 46, replace “circumferential slots 41” with -- circumferential slots 42 --;
line 48, replace “42” with -- 41 --;
line 61, after “10” insert -- , --.

Column 5, line 9, replace “1” with -- 10 --.

Signed and Sealed this

Thirtieth Day of December, 2008

JON W. DUDAS
*Director of the United States Patent and Trademark Office*